US008235630B2

(12) United States Patent
Van De Coterlet

(10) Patent No.: US 8,235,630 B2
(45) Date of Patent: Aug. 7, 2012

(54) METHOD FOR PRODUCING A SHEET PILE WALL AND SHEET PILE PLANK THEREFOR

(76) Inventor: Johannes Gerardus Van De Coterlet, Bunschoten (NL)

( * ) Notice: Subject to any disclaimer, the term of this patent is extended or adjusted under 35 U.S.C. 154(b) by 595 days.

(21) Appl. No.: 11/698,302

(22) Filed: Jan. 25, 2007

(65) Prior Publication Data

US 2007/0183851 A1 Aug. 9, 2007

(30) Foreign Application Priority Data

Jan. 25, 2006 (NL) ..... 1030999

(51) Int. Cl.
*E02D 5/08* (2006.01)

(52) U.S. Cl. ..... 405/279; 405/278

(58) Field of Classification Search ..... 405/274–282
See application file for complete search history.

(56) References Cited

U.S. PATENT DOCUMENTS

| | | | | | |
|---|---|---|---|---|---|
| 732,401 | A | * | 6/1903 | Dungan | 405/14 |
| 748,705 | A | * | 1/1904 | Davis | 405/274 |
| 816,770 | A | * | 4/1906 | Zander | 405/274 |
| 905,672 | A | * | 12/1908 | Edmunds | 405/274 |
| 912,949 | A | * | 2/1909 | Friestedt | 405/277 |
| 1,431,273 | A | * | 10/1922 | Webb et al. | 405/279 |
| 1,805,086 | A | * | 5/1931 | Guyer | 405/278 |
| 3,302,412 | A | * | 2/1967 | Hunsucker | 405/278 |
| 3,411,305 | A | * | 11/1968 | Cella | 405/280 |
| 3,688,509 | A | * | 9/1972 | Van Weele | 405/281 |
| 3,822,557 | A | * | 7/1974 | Frederick | 405/248 |
| 4,083,192 | A | * | 4/1978 | Diekman | 405/281 |
| 5,938,375 | A | | 8/1999 | Wheeler, Jr. et al. | |
| 5,957,625 | A | | 9/1999 | Vales | |
| 7,488,140 | B2 | * | 2/2009 | Nottingham | 405/279 |

FOREIGN PATENT DOCUMENTS

| | | |
|---|---|---|
| DE | 315 138 | 10/1919 |
| EP | 0 628 662 | 12/1994 |
| EP | 0 715 027 | 6/1996 |
| NL | 9 301 637 | 4/1995 |

* cited by examiner

*Primary Examiner* — Tara Mayo-Pinnock
(74) *Attorney, Agent, or Firm* — The Webb Law Firm

(57) ABSTRACT

A method for driving a number of sheet pile planks which have jaw slots into the ground, having the steps of: providing a previous sheet pile plank provided with at least one discontinuity, driving this previous sheet pile plank into the ground, causing the jaw slots of a previous sheet pile plank driven into the ground and a next sheet pile plank to interlock, driving the next sheet pile plank into the ground while maintaining the interlocking of said jaw slots, causing the next sheet pile plank to interact with the discontinuity of the previous sheet pile plank, and stopping the process of driving the next sheet pile plank into the ground after this mechanical event has been detected at the top end of this sheet pile plank.

16 Claims, 3 Drawing Sheets

METHOD FOR PRODUCING A SHEET PILE WALL AND SHEET PILE PLANK THEREFOR

BACKGROUND OF THE INVENTION

1. Field of the Invention

The invention relates to a method for producing a sheet pile wall from a number of sheet pile planks.

2. Description of the Prior Art

As is known, such sheet pile planks, on their longitudinal sides, are provided with jaw slots which are pushed into one another when the next sheet pile planks are driven into the ground. Thereby, a sheet pile wall is obtained which provides a good sealing, which may be important for a variety of reasons. The sealing may, for example, be necessary in order to separate one section of the ground in which the sheet pile wall is positioned from another section which may, for example, be contaminated. Such sheet pile planks are also used with harbour quays, where the sheet pile wall then has the function to retain the ground behind it and to protect it against the effects of the water.

For this reason, it is very important that the respective jaw slots interlock over the entire height of the sheet pile planks. In this connection, the client demands that the contractor demonstrate that the sheet pile planks have been arranged in the desired manner, that is to say maintaining the interlocking of the jaw slots. As the sheet pile planks are situated in the ground, certain measures have to be taken in order to make it possible to satisfy this requirement. In the past, various so-called jaw indicators have already been proposed, the purpose of which is to indicate to what extent the jaw slots indeed interlock over their entire height.

In accordance with a known jaw indicator, a sensor is positioned at the bottom of the sheet wall planks, at the jaw slot thereof. This sensor is connected to a measuring device on the surface of the ground via an electric wire, which has to extend over the entire height of the sheet pile plank. In order to protect the electric wire, a special tube is welded onto the sheet pile plank, through which this wire is pulled. As soon as the bottom end of the next sheet pile plank comes close to the sensor, this can be detected by means of the measuring device.

However, in practice, this known jaw indicator has proven not to work very well. First of all, the (delicate) sensor, which is situated at the bottom end of the sheet pile plank, may become defective during the operation of driving the sheet pile plank in question into the ground. Furthermore, the electric wire may be damaged despite the protection offered by the tube. A further drawback is the fact that, once the sheet pile plank has been removed from the ground, the tube is often partially loose and has to be removed before the sheet pile plank can be installed again.

With another jaw indicator, an indicator element to which a wire is connected is incorporated under the slot. This wire is pulled down into the ground with the sheet pile plank when the latter is driven into the ground. When the next sheet pile plank is then driven into the ground, this will push the indicator element out of the slot of the previous sheet pile plank. This can be detected at the surface by the fact that the wire of the indicator element can now be pulled up out of the ground. However, the drawback of this known indicator element is that the maximum depth over which the sheet pile plank can be driven into the ground is limited. At greater depths, the friction of the wire becomes so great that it can no longer be readily pulled out of the ground and, therefore, it is no longer possible to detect whether the indicator element has been removed from the jaw slot of the previous sheet pile plank.

It is therefore an object of the invention to provide a method for producing a sheet pile wall from sheet pile planks, in which it is possible to check in a simple and reliable manner whether the jaw slots interlock in the desired way.

SUMMARY OF THE INVENTION

This object is achieved by means of a method for driving a number of sheet pile planks into the ground, which sheet pile planks each have a nominal cross section and interlocking jaw slots on their longitudinal sides, comprising the steps of:

- providing a previous sheet pile plank provided with a discontinuity which forms a deviation from the nominal cross section of the sheet pile plank and which impedes and/or prevents the displacement of a next sheet pile plank relative to the previous sheet pile plank,
- driving this previous sheet pile plank into the ground,
- causing the jaw slots of the previous sheet pile plank driven into the ground and a next sheet pile plank to interlock,
- driving the next sheet pile plank into the ground while maintaining the interlocking of said jaw slots,
- causing the next sheet pile plank to interact with the discontinuity of the previous sheet pile plank in order to generate a mechanical event in this previous sheet pile plank which can be detected at the top end of this previous sheet pile plank.

In contrast to the sheet pile planks which are used in the prior art, the sheet pile planks according to the invention have at least one discontinuity which forms a deviation from the nominal cross section of the sheet pile planks. Thus, an event can be generated which results, for example, from sheet pile planks which move relative to one another colliding at such a discontinuity. Such a collision or any other impediment of the relative movement of the sheet pile planks which may occur generates an event, such as a vibration, slight movement and the like, which can be detected at the surface. By means of the event, it is possible to determine if the jaw slots of the respective sheet pile planks interlock over their entire length, and thus whether the desired sealing is ensured.

If the jaw slots have come apart at a certain level before the discontinuity has been reached, the relevant event will not occur. The fact that the jaw slots have come apart may still lead to an increased movement resistance between the jaw slots, but the event resulting therefrom can clearly be distinguished from the desired event which occurs if the sheet pile planks contact one another at the location of the discontinuity. After all, the event related to the jaw slots coming apart will occur before the head of the respective next sheet pile plank has reached the level where the correct event will take place which is related to the collision at the location of the discontinuity.

The advantage of the method is that it does not require the use of any electrical or electronic components which are, after all, relatively susceptible to defects resulting from the heavy work connected with the sheet pile planks being driven into the ground. The sheet pile planks may in this case be driven into the ground by ramming, static pressing or by means of vibration. Such relatively heavy operations put a heavy strain on the delicate electrical or electronic components, which can be omitted with the method according to the invention and thus no longer cause any failures. A further important advantage of the method according to the invention is the fact that the costs of the indicator system can be limited to a minimum.

Each of the relevant sheet pile planks may be part of series of sheet pile planks which have been attached to one another beforehand, as is usual on the prior art. With such series, the sheet pile planks may already have been attached to one another in the factory in sets of two or three by means of welding, punching and the like. Such a series consisting of two, three or more sheet pile planks can subsequently be driven into the ground in its entirety, provided the composition of the ground allows this.

The method according to the invention can be implemented in various ways. According to a first possible implementation, the method according to the invention comprises the step of:

stopping the process of driving the next sheet pile plank into the ground after this mechanical event has been detected at the top end of the previous sheet pile plank.

The process of driving the sheet pile planks into the ground can be stopped immediately after the event has been detected, but this is not imperative. If the discontinuity allows for it, the method according to the invention may also comprise the step of:

continuing the process of driving the next sheet pile plank into the ground over a distance which is at most an order of magnitude smaller than the length of this sheet pile plank.

The distance over which the process of driving a sheet pile plank into the ground is continued after the event has been detected, will generally have to be determined accurately in order to reach the desired end position. It is then at least ensured that the sheet pile planks interlock over the largest part of their length, and very likely over their entire length.

In this connection, the method according to the invention may also comprise the step of:

removing the discontinuity after the mechanical event has been detected. This may be effected, for example, by driving the next sheet pile plank further into the ground after the event has been detected.

Of course, the discontinuity has to be designed in such a way that it can be removed without damaging the rest of the sheet pile plank. To this end, the method according to the invention may comprise the step of:

knocking the discontinuity off the previous sheet pile plank by driving the next sheet pile plank further into the ground, such as knocking it off at a nominal breaking location of the discontinuity.

According to a further possible implementation, the method comprises the steps of:

creating an obstruction in the passage of the jaw slot of the at least one previous sheet pile plank, causing the bottom end of the next sheet pile plank to collide with this obstruction, causing the at least one previous sheet pile plank to move under the effect of the collision of the bottom end of the next sheet pile plank with the obstruction, detecting a movement of the top end of the at least one previous sheet pile plank.

Subsequently, the step may comprise:

stopping the process of driving the next sheet pile plank into the ground once this movement of the top end of the at least one previous sheet pile plank has been detected.

In this case as well, the discontinuity may, if desired, subsequently be removed.

With this variant of the method according to the invention, only one discontinuity actually has to be provided on each sheet pile plank, which discontinuity is situated in a guide slot. The bottom of the next sheet pile plank then simply hits this discontinuity, which can be detected by a slight movement of the previous sheet pile plank.

The method according to the invention can be implemented with sheet pile planks of equal length as well as with sheet pile planks having different lengths. The latter may be the case, for example, when building tunnels where the entry and exit ramps are relatively shallow. In this connection, a distinction can be made between two different cases. In a first case, in which the sheet pile planks have different lengths, and a previous sheet pile plank has a greater length than a next sheet pile plank, the method according to the invention comprises the step of:

providing the discontinuity at a distance from the head of the previous sheet pile plank which equals the length of the next sheet pile plank. The discontinuity is now not at the very bottom of the sheet pile plank, but at a certain level between both ends, which level depends on the length of the next sheet pile plank.

According to a second variant of the method according to the invention, the latter can also be applied in cases where the next sheet pile plank has a greater length than the previous sheet pile plank. In this case, the method according to the invention comprises the steps of:

providing a next sheet pile plank which has a discontinuity which forms a deviation from the nominal cross section of the sheet pile plank, causing the discontinuities of a next sheet pile plank and a previous sheet pile plank to interlock.

If sheet pile planks having different lengths, that is to say where a previous sheet pile plank has a smaller length than a next sheet pile plank, are then used, the method according to the invention comprises the step of:

providing discontinuities on the previous sheet pile plank and the next sheet pile plank, respectively, which are at equal distances to the associated head.

In that case, the discontinuities of a previous sheet pile plank and a next sheet pile plank define stops facing one another. In that case, each sheet pile plank then has two discontinuities on the longitudinal sides which are turned away from one another. Such discontinuities are necessarily located outside the contour of the nominal cross section of the relevant sheet pile plank, as these have to touch one another outside the jaw slots.

As soon as a signal has been emitted by means of the collision caused by the discontinuity, this discontinuity is no longer required. In this connection, the method according to the invention may comprise the step of removing the discontinuity after the event has been detected. This can be achieved, for example, by removing the discontinuity by driving the next sheet pile plank further into the ground.

In particular, the method may comprise the step of knocking the discontinuity off the previous sheet pile plank, such as knocking it off at a nominal breaking location, by driving the next sheet pile plank further into the ground.

The advantage of removing the discontinuity is that, should the sheet pile planks be pulled out of the ground, it does not matter in which order this is carried out.

The invention also relates to a sheet pile plank for use with the abovementioned method, which sheet pile plank is provided with a body as well as with jaw slots provided on both sides of that body. The sheet pile plank according to the invention differs from the known sheet pile planks in that, in a first possible embodiment, one and only one of the jaw slots is provided with a discontinuity which reduces the free passage of this at least one jaw slot. In particular, the discontinuity can be formed by a complete closure of the jaw slot. The closure may, for example, consist of a bolt whose screw thread diameter is slightly larger than the internal transverse dimensions of the jaw slot.

In many cases, sheet pile planks of equal length will be used. In those cases, it is not desirable if a next sheet pile plank has a head which is at a higher level than the head of a previous sheet pile plank. According to a first option, this can be achieved, for example, by arranging the stop or discontinuity just beyond the bottom end of the previous sheet pile plank. However, according to a preferred embodiment, the other jaw slot is provided with a recess at the same end. The height of this recess is approximately equal to the height over which the discontinuity extends. In particular, the recess may have a height which is equal to the length of the shank of the bolt.

According to a second variant, the sheet pile plank may be provided on both longitudinal sides with discontinuities which are situated outside the jaw slots extending on these longitudinal sides. These discontinuities define stops which face in opposite directions, in such a manner that a discontinuity of a previous sheet pile plank defines an upwardly directed stop, and a discontinuity of a next sheet pile plank defines a downwardly directed stop. These stops are situated on the longitudinal edges of the previous and the next sheet pile plank, which longitudinal edges face one another.

In the case of sheet pile planks of equal length, the discontinuities may be situated at one end. However, if the sheet pile planks are not of equal length, the discontinuities may be on different levels in the longitudinal direction.

Furthermore, the sheet pile plank 20 may be designed such that the discontinuity is formed by a complete closure of the jaw slot.

In connection with the removal of the discontinuity, the latter may optionally be provided with a nominal weakening line.

BRIEF DESCRIPTION OF THE DRAWINGS

Below, the invention will be explained in more detail with reference to a number of exemplary embodiments illustrated in the figures, in which.

DETAILED DESCRIPTION OF THE INVENTION

Figure 1:
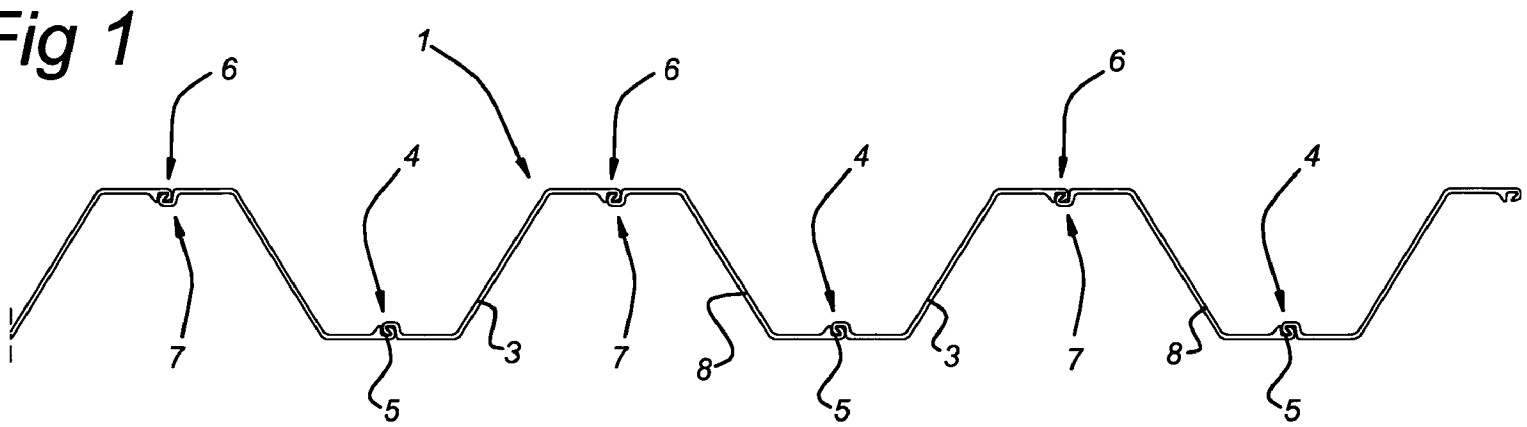
FIG. 1 shows a top view of a sheet pile wall.
Figure 2:
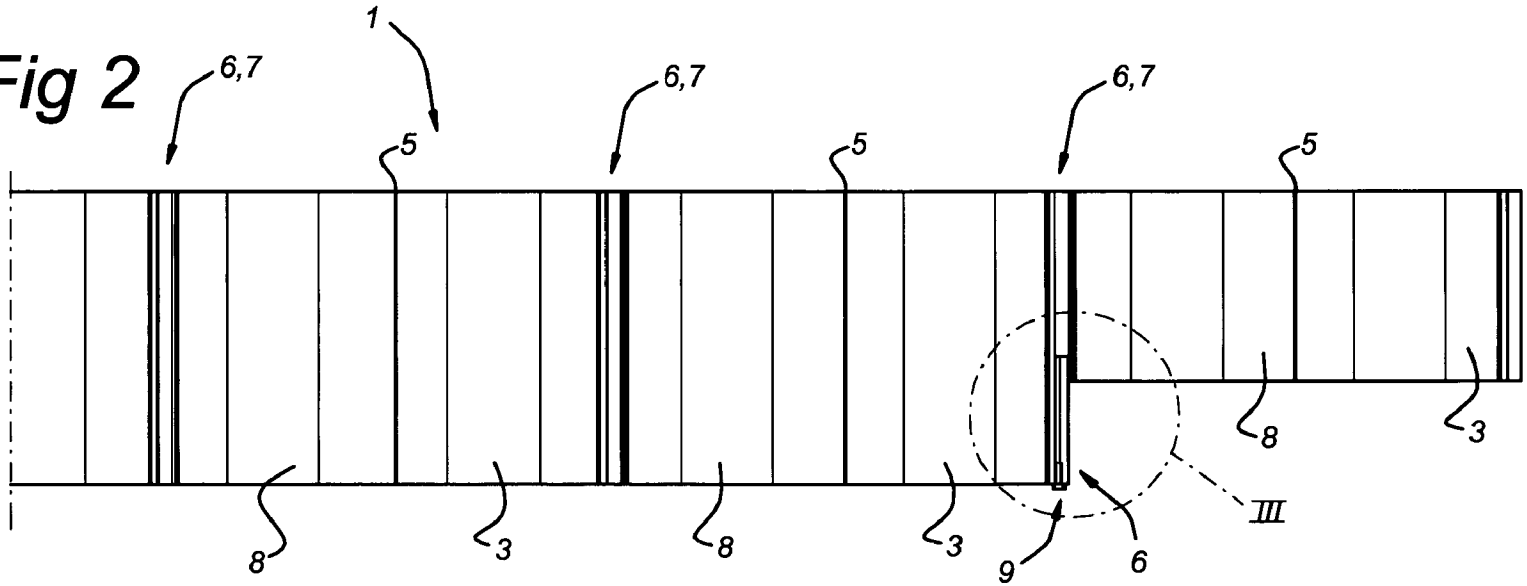
FIG. 2 shows a front view of a sheet pile wall during its production.
Figure 3:
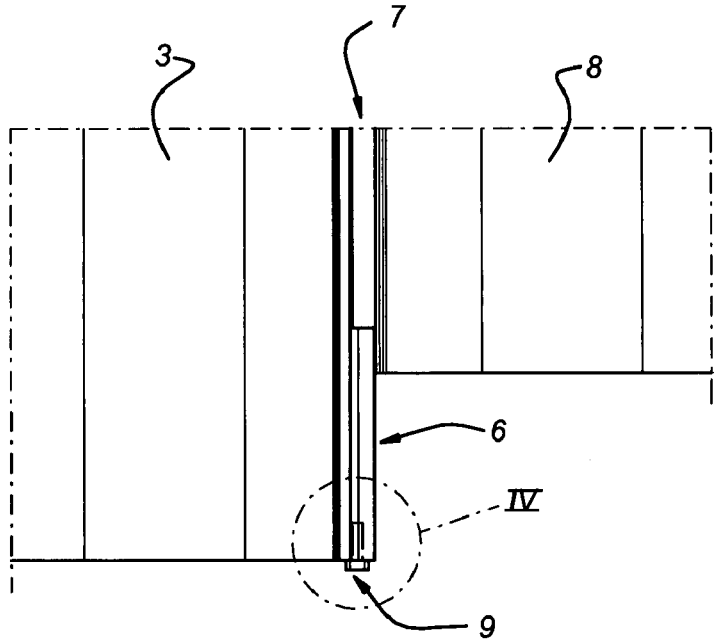
FIG. 3 shows an enlarged detail of III from FIG. 2.

The sheet pile wall 1 illustrated in FIGS. 1 and 2 comprises a number of sheet pile planks 3, 8 which are in each case assembled beforehand to form series 4. That is to say that in each case two of these sheet pile planks 3, 8 are permanently attached to one another at the location of their jaw slots 5 by means of welding, punching and the like. At the location of the jaw slots 6, 7, the sheet pile planks 3, 8 can be pushed into one another. The previous sheet pile plank 3 is in this case already at the desired depth, while the next sheet pile plank 8 is moved downwards, for example by a vibrating device or a pile-driving device which is known per se and which acts on the top ends of these sheet pile planks.

Figure 4:
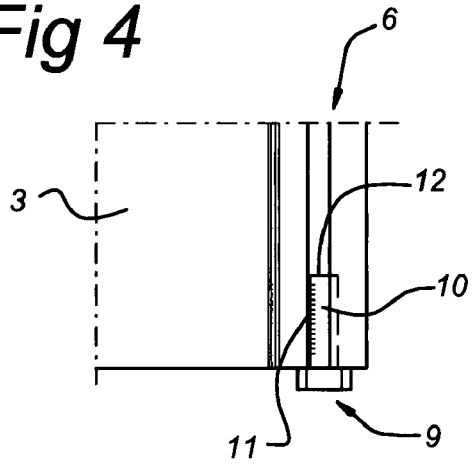
FIG. 4 shows a view of the bottom of a previous sheet pile plank.
Figure 5:
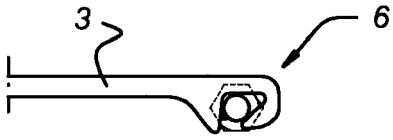
FIG. 5 shows the bottom view of FIG. 4.

When installing the next sheet pile plank 8, it has to be ensured that the interlock between the jaw slot 7 thereof and the jaw slot 6 of the previous sheet pile plank 3 is maintained over the entire height. Only then can it be ensured that the finished sheet pile wall 1 is able to guarantee the desired sealing in the ground. In connection with the monitoring thereof, a bolt 9 is driven into the bottom end of the jaw slot 6 of the previous sheet pile plank 3. As can be seen, in particular in FIGS. 4 and 5, the shank 10 of the bolt 9, which has a slightly oversized screw thread, is driven into the jaw slot 6 and secured by means of a weld 11. The end of the bolt 9 forms a stop face 12.

Figure 6:
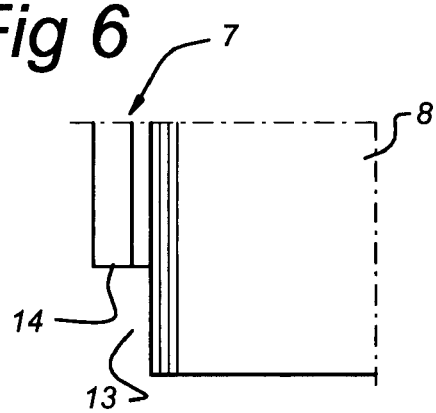
FIG. 6 shows a view of the bottom of a next sheet pile plank.
Figure 7:
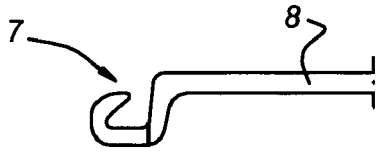
FIG. 7 shows a bottom view of FIG. 6.

As is illustrated in FIGS. 6 and 7, the bottom end of the jaw slot 7 has a recess 13, the height of which corresponds to the length of the shank 10 of the jaw bolt 9. When the next sheet pile plank 8 is moved downwards, the jaw slot 7 thereof is gradually displaced further relative to the jaw slot 6 of the previous sheet pile plank 3. As long as these jaw slots 7 and 6 remain interlocking, the stop face 14 formed by the bottom end of the jaw slot 7, adjacent to the recess 13 therein, as soon as the next sheet pile plank 8 is displaced sufficiently far downwards, will touch the stop face 12 turned upwards and located at the end of the bolt 9. The continuing load on the next sheet pile plank 8, as exerted by a pile-driving device or a vibrating device, will result in a load also being exerted on the previous sheet pile plank 3. This load can be detected at the head of the top end of this previous sheet pile plank 3 in the form of a slight displacement or vibration, which thus indicates that the next sheet pile plank 8 has reached the intended destination. Subsequently, the vibrating device or the pile-driving device can be shut down.

Such a procedure is also conceivable in case the next sheet pile plank 8 is shorter than the previous sheet pile plank 3. In that case, the stop 12 has to be positioned at a higher level in the jaw slot 6 of the previous sheet pile plank 3. The next sheet pile plank 8 will then touch the stop 12 with its stop face 14 when this next sheet pile plank 8 has not reached the bottom level of the previous sheet pile plank 3 yet. The level at which this stop 12 is then positioned in the jaw slot 6 of the previous sheet pile plank 3 is preferably chosen such that, in the position which is ultimately reached, the heads or top ends of the sheet pile planks 3, 8 are at the intended level. This may be the same level, but it may also be different levels.

Figure 8:
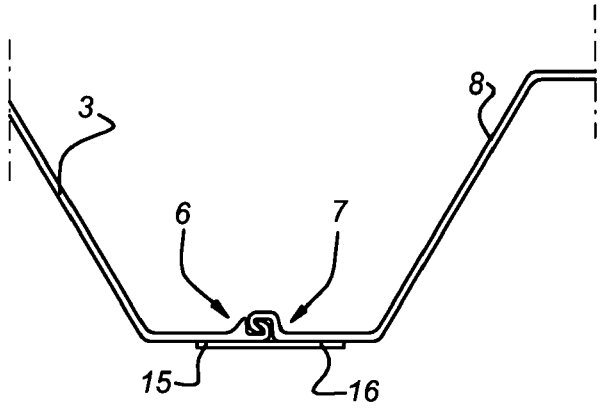
FIG. 8 shows a top view of a second variant of a sheet pile wall.
Figure 9:
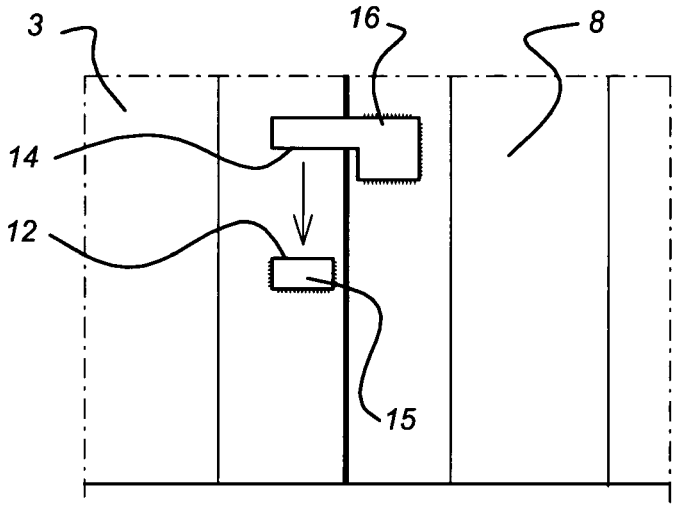
FIG. 9 shows a front view during production of the sheet pile wall according to FIG. 8 in a first phase.
Figure 10:
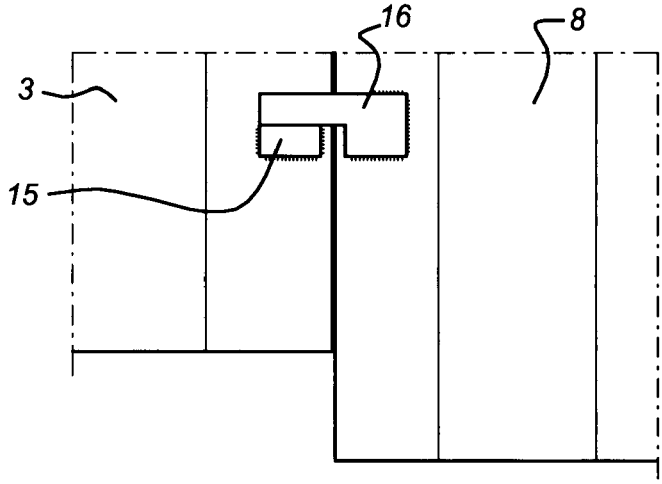
FIG. 10 shows a front view of the sheet pile wall from FIG. 9 in the finished state of the sheet pile wall.

However, the method according to the invention can also be applied in those cases where the next sheet pile plank 8 is longer than the previous sheet pile plank 3, and thus has to be driven into the ground to a deeper level than the previous sheet pile plank 3. As illustrated in FIGS. 8-10, this can be achieved by providing an external block 15 on the previous sheet pile plank 3 which is remote from the jaw slot 6. The next sheet pile plank 8 in turn has a stop lug 16, which is located on the side facing the jaw slot 7. The advantage of this stop lug 16 is that it has a stabilizing effect on the interlocking of the jaw slots 6, 7.

If, as indicated in FIGS. 9 and 10, the next sheet pile plank 8 has been driven into the ground sufficiently far, the stop face 14 of the stop lug 16 comes to lie against the stop 12 of the block 15, as a result of which the definitive level of the next sheet pile plank 8 has been reached. The collision associated with this action can be detected at the top end of the previous sheet pile plank 3 and subsequently, the ramming or vibrating can be stopped. Also, it is then ensured that the jaw slots 6, 7 interlock over the entire height in a reliable manner.

The invention claimed is:

1. A method for driving a number of sheet pile planks into the ground, which sheet pile planks each have a nominal cross section and interlocking jaw slots on their longitudinal sides, comprising the steps of:

providing a previous sheet pile plank having at least one discontinuity which forms a deviation from the nominal cross section of the sheet pile plank and which impedes and/or prevents the displacement of a next sheet pile plank relative to the previous sheet pile plank, driving this previous sheet pile plank into the ground, causing the jaw slots of the previous sheet pile plank driven into the ground and a next sheet pile plank to interlock, driving the next sheet pile plank into the ground while maintaining the interlocking of said jaw slots, interacting the next sheet pile plank with the discontinuity of the previous sheet pile plank in order to generate a mechanical event in at least one of these sheet pile planks which can be detected at the top end of this sheet pile plank, and detecting the mechanical event in at least one of these sheet pile planks at the top end thereof, wherein said mechanical event is chosen from the group consisting of: an occurrence of a stop or retardation in a downward movement of the next sheet pile plank while driving in the next sheet pile plank, an occurrence of a downward movement of the previous sheet pile plank while driving in the next sheet pile plank, and an occurrence of both the top or retardation in the downward movement of the next sheet pile plank while driving in the next sheet pile plank and the downward movement of the previous sheet pile plank while driving in the next sheet pile plank.

2. The method according to claim 1, further comprising the step of:

stopping the process of driving the next sheet pile plank into the ground after this mechanical event has been detected at the top end of this sheet pile plank.

3. The method according to claim 1, further comprising the step of:

continuing the process of driving the next sheet pile plank into the ground over a distance which is at most an order of magnitude smaller than the length of this sheet pile plank.

4. The method according to claim 1, further comprising the step of:

removing the discontinuity after the mechanical event has been detected.

5. The method according to claim 4, further comprising the step of:

removing the discontinuity by driving the next sheet pile plank further into the ground.

6. The method according to claim 5, further comprising the step of:

knocking the discontinuity off the previous sheet pile plank by driving the next sheet pile plank further into the ground, and knocking it off at a nominal breaking location of the discontinuity.

7. The method according to claim 1, further comprising the step of:

using a previous sheet pile plank which forms part of a previous series of at least two sheet pile planks attached to one another beforehand.

8. The method according to claim 1, further comprising the step of:

using a next sheet pile plank which forms part of a next series of at least two sheet pile planks attached to one another beforehand.

9. The method according to claim 8, further comprising the step of:

using a next sheet pile plank whose other, free jaw slot has a discontinuity.

10. The method according to claim 1, further comprising the steps of:

creating an obstruction in the passage of the jaw slot of the previous sheet pile plank, causing the bottom end of the next sheet pile plank to collide with this obstruction, causing the previous sheet pile plank to move under the effect of the collision of the bottom end of the next sheet pile plank with the obstruction, and detecting a movement of the top end of the previous sheet pile plank.

11. The method according to claim 10, further comprising the step of:

stopping the process of driving the next sheet pile plank into the ground once this movement of the top end of the previous sheet pile plank has been detected.

12. The method according to claim 1, further comprising producing a sheet pile wall from sheet pile planks which in each case comprise one and only one discontinuity.

13. The method according to claim 1, wherein the sheet pile planks have different lengths and a previous sheet pile plank has a greater length than a next sheet pile plank, further comprising the step of:

providing the discontinuity at a distance from the head of the previous sheet pile plank which equals the length of the next sheet pile plank.

14. The method according to claim 1, further comprising the steps of:

providing a next sheet pile plank which has a discontinuity which forms a deviation from the nominal cross section of the sheet pile plank, and causing the discontinuities of a next sheet pile plank and a previous sheet pile plank to interlock.

15. The method according to claim 14, wherein the sheet pile planks have different lengths and a previous sheet pile plank has a smaller length than a next sheet pile plank, further comprising the step of:

providing discontinuities on the previous sheet pile plank and the next sheet pile plank, respectively, which are at equal distances to the associated head.

16. The method according to claim 14, wherein the discontinuities of a previous sheet pile plank and a next sheet pile plank define stops facing one another.

* * * * *